United States Patent [19]

Morrison

[11] Patent Number: 4,651,138

[45] Date of Patent: Mar. 17, 1987

[54] INTRUDER ALARM SYSTEM

[76] Inventor: John M. Morrison, 54 Glasgow Road, Edinburgh EH12, Scotland

[21] Appl. No.: 468,552

[22] Filed: Feb. 22, 1983

[30] Foreign Application Priority Data

Feb. 26, 1982 [GB] United Kingdom ..... 8205783

[51] Int. Cl.[4] ..... G08B 29/00

[52] U.S. Cl. ..... 340/510; 340/511; 340/506

[58] Field of Search ..... 340/517, 510, 511, 506, 340/508, 870.21

[56] References Cited

U.S. PATENT DOCUMENTS

| | | | |
|---|---|---|---|
| 3,588,890 | 6/1971 | Cox et al. | 340/510 |
| 3,646,552 | 2/1972 | Fuhr | 340/510 |
| 3,829,850 | 8/1974 | Guetersloh | 340/511 X |
| 3,866,202 | 2/1975 | Reiss et al. | 340/511 |
| 4,028,057 | 6/1977 | Nelson | 340/510 X |
| 4,339,746 | 7/1982 | Ulicki et al. | 340/506 X |
| 4,348,661 | 9/1982 | Lucchesi | 340/506 X |
| 4,441,100 | 4/1984 | Galloway | 340/510 X |
| 4,491,828 | 1/1985 | Galvin et al. | 340/506 X |
| 4,524,349 | 6/1985 | Hyatt | 340/506 X |

*Primary Examiner*—James L. Rowland
*Assistant Examiner*—Jeffery A. Hofsass
*Attorney, Agent, or Firm*—Gerald J. Ferguson, Jr.; Michael P. Hoffman; Ronni S. Malamud

[57] ABSTRACT

An intruder alarm system includes a number of sensors each of which comprises first and second series-connected resistances and a sensor switch connected in parallel with the first resistance. The first resistances of each sensor are different in value from one another, but their values are related in a known manner. The sensors are connected in series with one another by a connecting cable and to a constant current source. The voltage developed across the series-connected sensors is applied to a circuit arrangement operable to offset the effect of the total resistance of the second resistances of each sensor and of the connecting cable. An analogue-to-digital converter is responsive to the output of the circuit arrangement to deliver a digital output to an indicator which indicates the actuation of any sensor.

8 Claims, 5 Drawing Figures

INTRUDER ALARM SYSTEM

This invention relates to intruder alarm systems of the type having a number of sensors, possibly of different types, guarding an area or a location. Many different forms of intruder alarm are known, ranging from very simple systems to complex and sophisticated microprocessor controlled systems.

One of the problems of any intruder alarm is that of preventing it from being tampered with or bypassed. The weak link is the sensor, since most types of sensors may be defeated by a person having the time and the ability necessary. Some sensors are difficult to defeat, but none are completely resistant to tampering.

It is an object of the invention to provide an intruder alarm which is more resistant to tampering than existing systems.

According to the present invention there is provided an intruder alarm system which includes a plurality of sensors each comprising first and second resistances connected in series with one another with an actuator switch connected in parallel with the first resistance, the first resistances of each sensor having values which are different from one another but which are related in a known manner, a connecting cable arranged to connect all of the sensors in series with one another, a constant current source connected to the series-connected sensors, a circuit arrangement responsive to the voltage developed across the series-connected sensors and operable to offset the effect of the total resistance of the second resistances of the sensors and of the connecting cable, an analogue-to-digital converter responsive to the output of the circuit arrangement to deliver a digital output the value of which is dependent upon the state of the sensor switches, and an indicator responsive to the output of the converter to indicate the actuation of a sensor.

The invention will now be described withreference to the accompanying drawings, in which.

Figure 1:
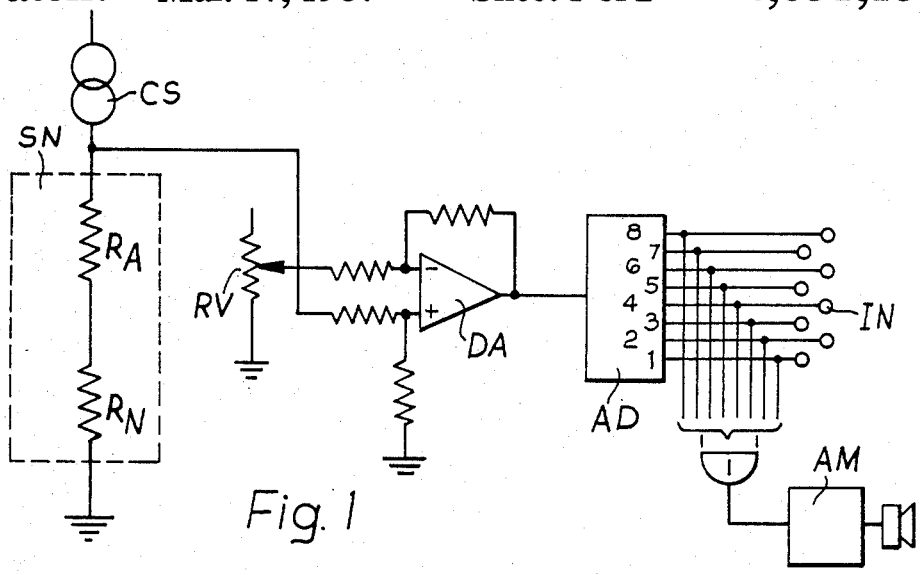
FIG. 1 is a schematic circuit diagram of an alarm system.

Referring now to FIG. 1, this shows the main elements of the alarm system. The plurality of sensors SN are represented by series-connected resistances $R_A$ and $R_N$, and a constant current source CS is connected to the series-connected sensors. The voltage developed across the series-connected sensors is applied to the non-inverting input of a differential amplifier DA. The inverting input of the amplifier is connected to a potentiometer RV, and the output of the amplifier is connected to an eight-bit analogue-to-digital converter AD. Indicators such as light-emitting diodes IN are connected to each output of the converter AD.

Figure 2:
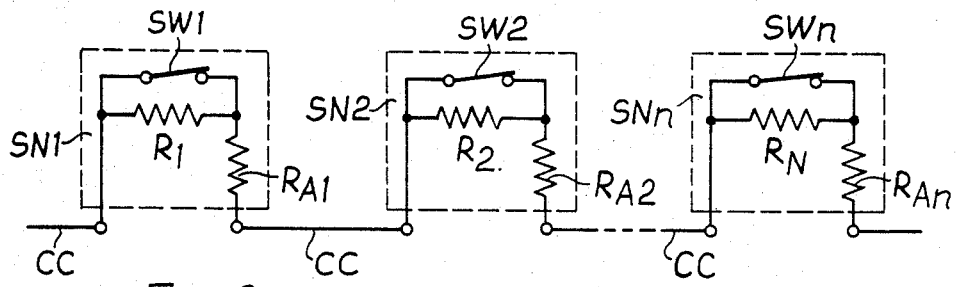
FIG. 2 is a circuit diagram showing the arrangement of sensors.

FIG. 2 illustrates the sensors, shown in broken outline. The same references are used for the same components of each sensor, with the suffixes 1, 2 . . . n denoting different sensors. From FIG. 2 it will be seen that each sensor comprises a switch SW connected in seriew with a first resistor R. The parallel combination of switch and first resistor is connected in series with a second resistor $R_A$.

The first resistor of each sensor is of a different value to that of each other first resistor, but the values are related to one another in a known manner. The second resistors $R_A$ are of different and purely arbitrary values.

The sensors are connected in series with one another by a connecting cable CC, one end of which is connected to the constant current source CS and the other end, conveniently, to earth potential as shown in FIG. 1.

In operation, assuming that all the switches are of the normally-closed type, then with all switches closed the voltage drop produced by current flowing from the constant current source CS will be due to the resistance $R_A$ and the resistance of the connecting cable CC. In this situation the potentiometer RV is adjusted to offset the effect of these resistances and to produce no output from the amplifier DA. This single setting-up operation is all that is required. The subsequent opening of one or more of the switches SW will increase the resistance through which the constant current flows, hence increasing the voltage on the input of amplifier DA and producing an output from the amplifier.

In a first embodiment, consider the case where no more than eight sensors are provided, and using an analogue-to-digital converter having eight outputs, the first resistors $R_N$ of which are related in value to one another in a binary ratio, that is in the ratios 1:2:4:8:16:32:64:128. The opening of any one switch SW will result in a unique voltage being applied to the amplifier DA and a unique output voltage from it. Hence the analogue-to-digital converter AD is arranged to provide an output on one only of its eight outputs, indicating directly which of the sensor switches has been operated. Even if more than one sensor switch is operated, the resulting input voltage to the amplifier DA has a unique value, and hence the identity of each operated sensor switch may be clearly shown by the LED indicators. As audible alarm AM may be actuated by any alarm indication.

Figure 3:
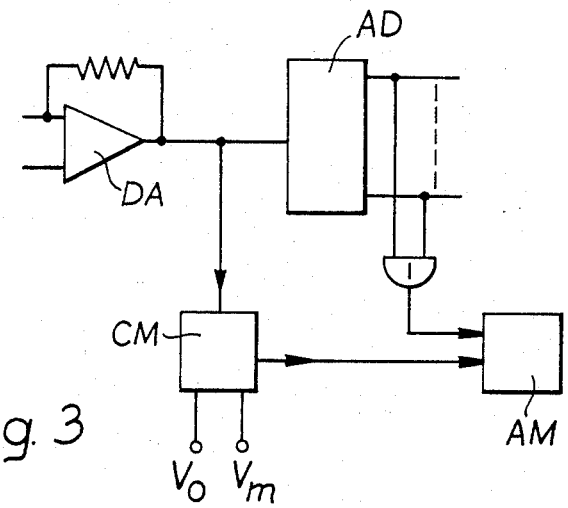
FIG. 3 shows a modification to the circuit of FIG. 1.

The second resistance $R_A$ in each sensor is provided to increase the difficulty of tampering with a sensor. If a sensor is short-circuited, then the voltage drop across the sensors will fall, and the output voltage of the amplifier DA will fall below zero. This may be detected by a comparator to give an indication of tampering. If the sensor chain is open-circuited, then the non-inverting input to the amplifier DA will have maximum voltage applied to it, and the output voltage of the amplifier will rise. FIG. 3 shows the addition of a comparator CM having zero ($V_o$) and maximum ($V_m$) reference voltages applied to it and giving an alarm indication if tampering is detected. This too may be detected. Any attempt to measure the voltage drop across an individual sensor so as to replace it by a resistance of the same value will not give the value of the resistor $R_N$ because of the presence of the resistor $R_A$. Any attempt to use such a shunting resistance will not prevent activation of the alarm. In order to prevent direct access to the sensor it is suggested that at least the two resistances, and possibly the switch if this is magnetically-operated, should be sealed in a potting compound.

In the embodiment described above, with up to eight resistors $R_N$ related in value in a binary manner, the resistances themselves must have a high tolerance, of the order of 0.1%, with low temperature coefficients. Variations of resistance due to temperature of the resistors $R_A$ and the connecting cable may be compensated by an automatic zeroing loop in which the output from the amplifier DA in the quiescent state is applied to an integrator which controls the offset input to the amplifier.

As indicated above, it is only by using binary-related values of resistor $R_N$, together with an analogue-to-digital converter having the appropriate number of outputs, that any sensor can be identified on operation. If the number of sensors is greater than this arrangement allows, the zone protection may be provided with clear identification of each zone, though not of individual sensors within a zone. This may be done by providing each sensor within a zone with resistors $R_N$ of the same value, with all sensors again connected in series. The zones may define areas of a building, or particular types of sensor such as door switches, window switches and the like.

Figure 4:
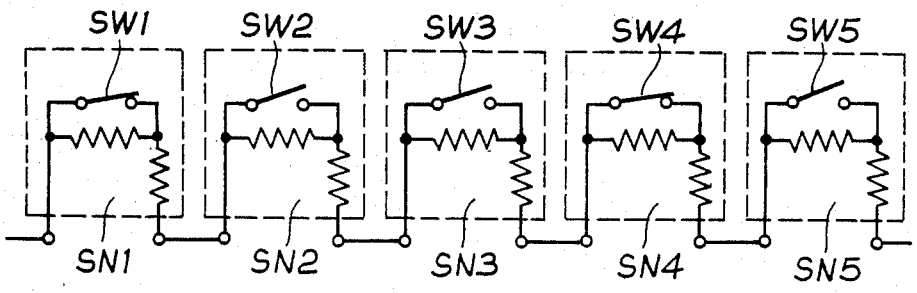
FIG. 4 illustrates a further modification.
Figure 4:
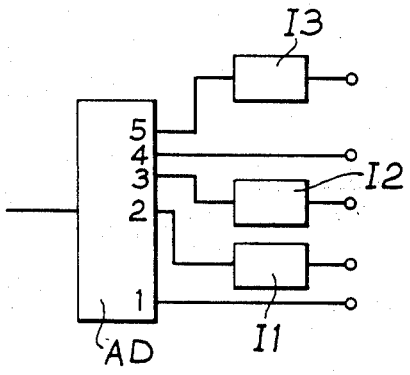

In the embodiment described above, it was assumed that all of the switches SW were of the normally-closed type. In some instances, it may be preferred to use a normally-open switch in one or more of the sensors. In the quiescent condition this would normally lead to an output from the analogue-to-digital converter. However, this may be corrected by placing inverters in the outputs from the converter corresponding to the normally-open sensor switches. This is illustrated in FIG. 4 in which five sensors are shown. Sensors SN2, SN3 and SN5 are shown as having normaly-open switches, and outputs 2, 3 and 5 from the converter AD have inverts I1, I2 and I3 connected to them. In setting up the circuit to offset the cable resistance and the resistance $R_A$, it will be necessary either to actuate the normally-open switches, or to determine the appropriate output voltage from the amplifier DA, since this will not be the value which would be obtained if all switches were closed.

No mention has been made of the type of sensor which may be used. Apart from simple switches, which may be mechanical or magnetically-operated reed switches for example, many other types of sensor may be used so long as the output element is a switch. Ultrasonic, infra red and microwave sensors are only a few of the known types of sensor which may be incorporated into an alarm system of the type described.

Figure 5:
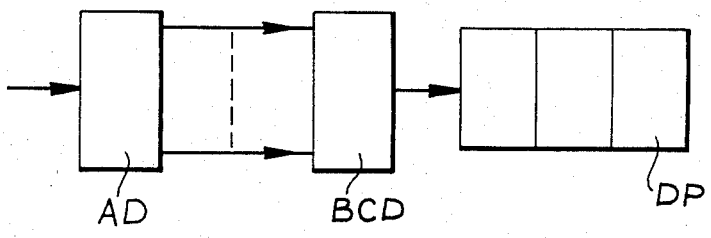
FIG. 5 illustrates a second embodiment of the invention.

In the arrangement described above an anaalogue-to-digital converter having eight outputs was used to identify uniquely the actuation of one or more of the eight sensors. Clearly an eight-bit parallel output will in fact respond to 256 different input conditions to give different output indications. If, therefore, up to 256 sensors are provided, with their resistances $R_N$ related by an arithmetic progression, i.e. 1, 2, 3, 4, 5 . . . 255, 256, then it is still possible to identify the first sensor to be actuated. However, if a number of sensors are actuated simultaneously then identification may not be possible. Similarly, it is not convenient to have an LED indicator for each sensor, but a multi-digit seven-bar display DP may be used, driven from the outputs of the analogue-to-digital converter AD by a binary-to-decimal converter BDC, as shown in FIG. 5. Any combination of outputs from the converter will result in the display of a number identifying the particular sensor.

It is still possible to identify all of a number of actuated sensors by processing the outputs of the converter AD, unless actuation of two or more sensors occurs absolutely simultaneously. This may be done by identifying the first sensor to operate; eliminating the effect of that one when a second operates, to identify the second sensor, and so on. Digital processing circuitry will operate sufficiently fast to identify sensors in turn.

The differential amplifier DA, analogue-to-digital converter AD and constant current source CS have not been described in detail as they are conventional and readily-available circuit elements.

I claim:

1. An intruder alarm system which includes a plurality of sensors each comprising first and second resistances connected in series with one another with an actuator switch connected in parallel with the first resistance, the first resistances of each sensor having values which are different from one another but which are related in accordance with a predetermined formula, the second resistances of each sensor having different and arbitrary values, a connecting cable arranged to connect all of the sensors in series with one another, a constant current source connected to the series-connected sensors, a circuit arrangement responsive to the voltage developed across the series-connected sensors and to give an output which corresponds to said voltage less the voltage produced by the second resistances and the resistance of the connecting cable, an analogue-to-digital converter responsive to the output of the circuit arrangement to deliver a digital output the value of which is dependent upon the state of the sensor switches, and an indicator responsive to the output of the converter to indicate the actuation of a sensor.

2. An alarm system as claimed in claim 1 in which the values of the first resistances of each sensor are related to one another by a binary sequence, the analogue-to-digital converter having a number of separate outputs equal at least to the number of sensors in the system.

3. An alarm system as claimed in claim 1 in which the values of the first resistances of each sensor are related to one another by an arithmetic progression, the analogue-to-digital converter having a number of outputs such that the number of combinations of output conditions is at least equal to the number of sensors in the system.

4. An alarm system as claimed in claim 1 in which the circuit arrangement comprises a differential amplifier having the voltage developed across the series-connected sensors applied to one input and a variable reference voltage applied to the other input.

5. An alarm system as claimed in claim 1 in which the indicator comprises a digital display operable to identify an actuated sensor.

6. An alarm system as claimed in either of claims 1 or 2 in which the indicator comprises a separate indicating device connected to each output of the analogue-to-digital converter.

7. An alarm system as claimed in claim 6 in which each indicating device comprises a light-emitting diode.

8. An alarm system as claimed in claim 1 which includes means for detecting a short-circuit or open-circuit condition at any one of the plurality of sensors.

* * * * *